US009945019B2

(12) United States Patent
Gu et al.

(10) Patent No.: US 9,945,019 B2
(45) Date of Patent: Apr. 17, 2018

(54) NICKEL-BASED HEAT-RESISTANT SUPERALLOY

(71) Applicant: NATIONAL INSTITUTE FOR MATERIALS SCIENCE, Ibaraki (JP)

(72) Inventors: Yuefeng Gu, Ibaraki (JP); Toshio Osada, Ibaraki (JP); Yong Yuan, Ibaraki (JP); Tadaharu Yokokawa, Ibaraki (JP); Hiroshi Harada, Ibaraki (JP)

(73) Assignee: NATIONAL INSTITUTE FOR MATERIALS SCIENCE, Ibaraki (JP)

( * ) Notice: Subject to any disclaimer, the term of this patent is extended or adjusted under 35 U.S.C. 154(b) by 0 days.

(21) Appl. No.: 15/372,500

(22) Filed: Dec. 8, 2016

(65) Prior Publication Data

US 2017/0081750 A1 Mar. 23, 2017

Related U.S. Application Data

(62) Division of application No. 14/365,236, filed as application No. PCT/JP2012/082467 on Dec. 14, 2012, now abandoned.

(30) Foreign Application Priority Data

Dec. 15, 2011 (JP) ..... 2011-274604

(51) Int. Cl.

| | |
|---|---|
| ***C22F 1/10*** | (2006.01) |
| ***C22C 19/05*** | (2006.01) |
| ***C22C 19/07*** | (2006.01) |
| ***C22F 1/00*** | (2006.01) |
| ***C22C 30/00*** | (2006.01) |
| ***B21J 5/02*** | (2006.01) |
| *F01D 5/28* | (2006.01) |
| *F01D 5/02* | (2006.01) |

(52) U.S. Cl.

CPC *C22F 1/10* (2013.01); *B21J 5/02* (2013.01); *C22C 19/05* (2013.01); *C22C 19/056* (2013.01); *C22C 19/07* (2013.01); *C22C 30/00* (2013.01); *C22F 1/00* (2013.01); *F01D 5/02* (2013.01); *F01D 5/28* (2013.01); *F05D 2300/175* (2013.01)

(58) Field of Classification Search

CPC ..... C22F 1/10

See application file for complete search history.

(56) References Cited

U.S. PATENT DOCUMENTS

| | | | |
|---|---|---|---|
| 4,957,567 | A | 9/1990 | Krueger |
| 5,080,734 | A | 1/1992 | Krueger et al. |
| 5,120,373 | A | 6/1992 | Miller et al. |
| 5,143,563 | A | 9/1992 | Krueger et al. |
| 5,529,643 | A | 6/1996 | Yoon et al. |
| 5,637,159 | A | 6/1997 | Erickson |
| 5,938,863 | A | 8/1999 | Malley |
| 8,734,716 | B2 | 5/2014 | Harada |
| 2008/0260570 | A1 | 10/2008 | Harada et al. |

FOREIGN PATENT DOCUMENTS

| | | |
|---|---|---|
| JP | 5-508194 | 11/1993 |
| JP | 2666911 | 6/1997 |
| JP | 2667929 | 6/1997 |
| JP | 10-195564 | 7/1998 |
| JP | 2003-89836 | 3/2003 |
| JP | 2009-7672 | 1/2009 |
| JP | 2011-12346 | 1/2011 |
| JP | 2011-236450 | 11/2011 |
| WO | 2006/059805 | 6/2006 |

OTHER PUBLICATIONS

International Search Report dated Mar. 19, 2013 in International (PCT) Application No. PCT/JP2012/082467.

*Primary Examiner* — Jessee Roe

(74) *Attorney, Agent, or Firm* — Wenderoth, Lind & Ponack, L.L.P.

(57) ABSTRACT

Disclosed herein is a nickel-based heat-resistant superalloy produced by a casting and forging method, the nickel-based heat-resistant superalloy comprising 2.0 mass % or more but 25 mass % or less of chromium, 0.2 mass % or more but 7.0 mass % or less of aluminum, 19.5 mass % or more but 55.0 mass % or less of cobalt, [0.17×(mass % of cobalt content−23)+3] mass % or more but [0.17×(mass % of cobalt content−20)+7] mass % or less and 5.1 mass % or more of titanium, and the balance being nickel and inevitable impurities, and being subjected to solution heat treatment at 93% or more but less than 100% of a γ' solvus temperature.

8 Claims, 3 Drawing Sheets

NICKEL-BASED HEAT-RESISTANT SUPERALLOY

CROSS REFERENCE TO RELATED APPLICATIONS

This Application is a divisional of U.S. application Ser. No. 14/365,236, filed on Jun. 13, 2014, now abandoned.

TECHNICAL FIELD

The present invention relates to a nickel-based heat-resistant superalloy used for heat-resistant members of aircraft engines, power-generating gas turbines, etc., especially for turbine disks or turbine blades.

BACKGROUND ART

For example, turbine disks, which are heat-resistant members of aircraft engines, power-generating gas turbines, etc., are rotary members that support turbine blades, and are subjected to much higher stress than turbine rotor blades. Therefore, turbine disks require a material excellent in mechanical characteristics, such as creep strength or tensile strength in a high-temperature and high-stress region and low-cycle fatigue characteristics, and forgeability. On the other hand, in order to improve fuel efficiency or performance, an increase in engine gas temperature and a reduction in the weight of turbine disks are required, and therefore the material is required to have higher heat resistance and higher strength.

In general, nickel-based forged alloys are used for turbine disks. For example, Inconel 718 (which is a registered trademark of The International Nickel Company, Inc.) using a γ" (gamma double prime) phase as a strengthening phase and Waspaloy (which is a registered trademark of United Technoligies, Inc.) using, as a strengthening phase, about 25 vol % of a precipitated γ' (gamma prime) phase stabler than a γ" phase are frequently used. Further, Udimet 720 (which is a registered trademark of Special Metals, Inc.) has been introduced since 1986 from the viewpoint of dealing with higher temperatures. Udimet 720 has about 45 vol % of a precipitated γ' phase and tungsten added for solid-solution strengthening of a γ phase, and is therefore excellent in heat-resistant characteristics.

On the other hand, the structural stability of Udimet 720 is not always sufficient, and a harmful TCP (Topologically close packed) phase is formed during use. Therefore, Udimit 720Li (U720Li/U720LI) has been developed by making improvements, such as a reduction in the amount of chromium, to Udimet 720. However, the formation of a TCP phase still occurs also in improved Udimit 720Li, and therefore the use of Udimit 720Li for a long time or at high temperature is limited.

Powder metallurgical alloys typified by AF115, N18, and Rene88DT are sometimes used for high-pressure turbine disks required to have high strength. The powder metallurgical alloys have a merit that homogeneous disks having no segregation can be obtained in spite of the fact that many strengthening elements are contained. On the other hand, the powder metallurgical alloys have a problem that their production process needs to be highly controlled, e.g., vacuum melting needs to be performed at a high cleaning level or a proper mesh size needs to be selected for powder classification, to suppress the mixing of inclusions and therefore their production cost is significantly increased.

In addition, many proposals have been made to improve the chemical compositions of conventional nickel-based heat-resistant superalloys. All of them contain cobalt, chromium, molybdenum or molybdenum and tungsten, aluminum, and titanium as their major constituent elements, and typical ones contain one or both of niobium and tantalum as their essential constituent element(s). The presence of niobium and/or tantalum is suitable for the above-described powder metallurgy, but is a factor making casting and forging difficult.

Titanium is added for its function of strengthening a γ' phase and improving tensile strength or crack propagation resistance. However, the amount of titanium added is limited to up to about 5 mass %, because excess addition of only titanium results in an increase in γ' solvus temperature and formation of a harmful phase, which makes it difficult to obtain a sound γ/γ' two-phase structure.

Under the circumstances, the present inventors have made a study of optimization of the chemical composition of a nickel-based heat-resistant superalloy and have found that a harmful TCP phase can be suppressed by actively adding cobalt in an amount of up to 55 mass %. Further, the present inventors have found that a γ/γ' two-phase structure can be stabilized by increasing both a cobalt content and a titanium content so that cobalt and titanium are contained in a predetermined ratio. Based on these findings, the present inventors have proposed a nickel-based heat-resistant superalloy that can withstand higher temperatures for a long time than conventional alloys and that has excellent workability (Patent Literature 1).

Further, some proposals focused on the microstructure of a nickel-based heat-resistant alloy have been made to improve the performance of the nickel-based heat-resistant superalloy (Patent Literatures 2, 3, and 4).

In a nickel-based heat-resistant superalloy produced by powder metallurgy, crystal grains are less likely to become too large even after solution heat treatment performed in a temperature region exceeding a γ' solvus temperature (at a supersolvus temperature), and therefore crystal grain size and grain size distribution are generally controlled by performing aging heat treatment after solution heat treatment performed in a temperature region exceeding a solvus temperature (e.g., Patent Literature 7). However, while crystal grains are less likely to become too large, it is often the case that the control of crystal grains is poor. Therefore, in order to avoid harmful growth of crystal grains during solution heat treatment performed in a temperature region exceeding a solvus temperature, the importance of strain rate control during forging has also been proposed (e.g., Patent Literatures 5 and 6). Further, in order to promote proper growth of crystal grains, a method has also been proposed in which a nickel-based heat-resistant alloy having a high carbon content is forged at a high local strain rate (Patent Literature 8).

However, the alloys described in the above Patent Literatures are powder alloys whose production process is complicated and production cost is high. The powder alloys vary in optimum microstructure according to their chemical composition, and are therefore considered to be applicable only to some limited materials and production methods.

On the other hand, when a nickel-based heat-resistant superalloy produced by a casting and forging method is subjected to solution heat treatment in a temperature region exceeding a solvus temperature, crystal grains become too large and therefore heat-resistant characteristics are significantly impaired. Therefore, in general, solution heat treatment is performed at 90% or less of a solvus temperature, and then aging heat treatment is performed.

At present, however, no nickel-based heat-resistant superalloy has been found which is produced by a conventional casting and forging method and has heat-resistant characteristics significantly higher than those of nickel-based heat-resistant superalloys produced by powder metallurgy. Therefore, there is a strong demand for development of a nickel-based heat-resistant superalloy that is produced by a casting and forging method capable of significantly simplifying its production process and that is superior also in terms of heat-resistant characteristics and cost to nickel-based heat-resistant superalloys produced by powder metallurgy.

Patent Literature 1: WO 2006/059805
Patent Literature 2: Japanese Patent No. 2666911
Patent Literature 3: Japanese Patent No. 2667929
Patent Literature 4: JP 2003-89836 A
Patent Literature 5: U.S. Pat. No. 4,957,567
Patent Literature 6: U.S. Pat. No. 5,529,643
Patent Literature 7: JP 2011-12346 A
Patent Literature 8: JP 2009-7672 A

SUMMARY OF INVENTION

Technical Problem

In order to achieve an improvement in energy efficiency, there has recently been an urgent need for development of a material of heat-resistant members of aircraft engines, power-generating gas turbines, etc. to allow the heat-resistant members to be used at higher temperatures. For example, there has been a strong demand for development of a novel alloy for turbine disks which is superior in mechanical characteristics such as fatigue strength, high-temperature creep strength, fracture toughness, and high-temperature fatigue crack resistance.

Under circumstances where no nickel-based heat-resistant superalloy has been found which is produced by a conventional casting and forging method and has heat-resistant characteristics significantly higher than those of nickel-based heat-resistant superalloys produced by powder metallurgy, the present inventors have made an intensive study to develop a nickel-based heat-resistant superalloy that is superior in terms of heat-resistant characteristics and cost to those produced by powder metallurgy. It is an object of the present invention to provide a nickel-based heat-resistant superalloy that is produced by a casting and forging method capable of significantly simplifying its production process and that is superior in heat-resistant characteristics to nickel-based superalloys produced by powder metallurgy.

Solution to Problem

The present inventors have intensively studied the solution heat treatment conditions of a nickel-based heat-resistant superalloy produced by a casting and forging method and having a specific alloy composition, and have found that a nickel-based heat-resistant superalloy excellent in both tensile strength and creep life at high temperature can be obtained by properly controlling especially a solution heat treatment temperature, which has led to the completion of the present invention. A casting and forging method is generally known as an inexpensive production process, and the present inventors have found that a nickel-based heat-resistant superalloy superior in high-temperature heat-resistant characteristics, which can be achieved only by powder metallurgy requiring high production cost, can be produced by a casting and forging method.

More specifically, the present invention is directed to a nickel-based heat-resistant superalloy produced by a casting and forging method, the nickel-based heat-resistant superalloy comprising 2.0 mass % or more but 25 mass % or less of chromium, 0.2 mass % or more but 7.0 mass % or less of aluminum, 19.5 mass % or more but 55.0 mass % or less of cobalt, [0.17×(mass % of cobalt content−23)+3] mass % or more but [0.17×(mass % of cobalt content−20)+7] mass % or less and 5.1 mass % or more of titanium, and the balance being nickel and inevitable impurities, and being subjected to solution heat treatment at 93% or more but less than 100% of a γ' solvus temperature.

It is preferred that in the nickel-based heat-resistant superalloy, the cobalt is contained in an amount of 21.8 mass % or more but 55.0 mass % or less.

Further, it is also preferred that in the nickel-based heat-resistant superalloy, the titanium is contained in an amount of 5.5 mass % or more but 12.44 mass % or less.

Further, it is also preferred that in the nickel-based heat-resistant superalloy, the titanium is contained in an amount of 6.1 mass % or more but 12.44 mass % or less.

Further, it is also preferred that the nickel-based heat-resistant superalloy is subjected to solution heat treatment at 94% or more but less than 100% of the γ' solvus temperature.

Further, it is also preferred that the nickel-based heat-resistant superalloy contains one or both of 10 mass % or less of molybdenum and 10 mass % or less of tungsten.

Further, it is also preferred that in the nickel-based heat-resistant superalloy, the molybdenum is contained in an amount of less than 4 mass %.

Further, it is also preferred that in the nickel-based heat-resistant superalloy, the tungsten is contained in an amount of less than 3 mass %.

Further, it is also preferred that the nickel-based heat-resistant superalloy contains one or both of 10 mass % or less of tantalum and 5.0 mass % or less of niobium.

Further, it is also preferred that the nickel-based heat-resistant superalloy contains at least one of 2 mass % or less of vanadium, 5 mass % or less of rhenium, 0.1 mass % or less of magnesium, 2 mass % or less of hafnium, and 3 mass % or less of ruthenium.

Further, it is also preferred that the nickel-based heat-resistant superalloy comprises 12 mass % or more but 14.9 mass % or less of chromium, 2.0 mass % or more but 3.0 mass % or less of aluminum, 20.0 mass % or more but 27.0 mass % or less of cobalt, 5.5 mass % or more but 6.5 mass % or less of titanium, 0.8 mass % or more but 1.5 mass % or less of tungsten, 2.5 mass % or more but 3.0 mass % or less of molybdenum, at least one of 0.01 mass % or more but 0.2 mass % or less of zirconium, 0.01 mass % or more but 0.15 mass % or less of carbon, and 0.005 mass % or more but 0.1 mass % or less of boron, and the balance being nickel and inevitable impurities.

The nickel-based heat-resistant superalloy according to the present invention that satisfies the following three requirements is excellent in both tensile strength and creep life at high temperature:

1) being a nickel-based heat-resistant superalloy produced by a casting and forging method;

2) comprising 2.0 mass % or more but 25 mass % or less of chromium, 0.2 mass % or more but 7.0 mass % or less of aluminum, 19.5 mass % or more but 55.0 mass % or less of cobalt, [0.17×(mass % of cobalt content−23)+3] mass % or more but [0.17×(mass % of cobalt content−20)+7] mass % or less and 5.1 mass % or more of titanium, and the balance being nickel and inevitable impurities; and 3) be subjected to solution heat treatment in a temperature region of 93% or more but less than 100% of a γ' solvus temperature.

DESCRIPTION OF EMBODIMENTS

Figure 1:
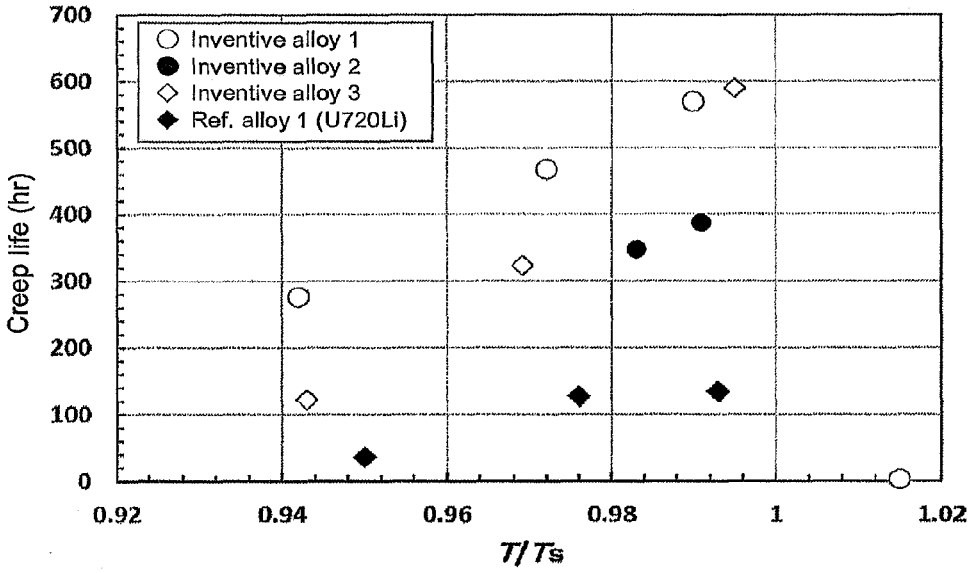
FIG. 1 shows a relationship between creep life (hr) and the ratio of solution heat treatment temperature (T) to γ' solvus temperature (Ts), which was determined by a creep test performed under conditions of 725° C. and 630 MPa.

As described above, when a nickel-based heat-resistant superalloy produced by a casting and forging method is subjected to solution heat treatment in a temperature region exceeding a solvus temperature, crystal grains generally become too large and therefore heat-resistant characteristics are significantly impaired. Particularly, it is said that tensile strength (0.2% proof stress) is significantly reduced. Further, it is said that even when the solution heat treatment is performed in a temperature region equal to or less than a solvus temperature (at a subsolvus temperature), crystal grains become coarse with an increase in solution heat treatment temperature, and therefore tensile strength (0.2% proof stress) is significantly reduced (e.g., J. C. Williams et al. Acta Mater, 51 (2003) 5775). However, the present inventors have found that even when produced by a casting and forging method, a nickel-based heat-resistant superalloy that is subjected to solution heat treatment not at a solution heat treatment temperature commonly used but at a high temperature of 93% or more but less than 100% of a γ' solvus temperature is excellent in both tensile strength (0.2% proof stress) and creep life even in a temperature region, in which excellent tensile strength and excellent creep life cannot conventionally be achieved, as long as the nickel-based heat-treatment superalloy is a high-cobalt and high-titanium alloy containing 19.5 mass % or more but 55.0 mass % or less of cobalt and [0.17×(mass % of cobalt content−23)+3] mass % or more but [0.17×(mass % of cobalt content−20)+7] mass % or less and 5.1 mass % or more of titanium.

A nickel-based heat-resistant superalloy according to the present invention contains, as major constituent elements, chromium, cobalt, titanium, aluminum, and nickel and may contain an addition ingredient and an inevitable impurity element.

Chromium is added to improve environment resistance or fatigue crack propagation characteristics. If a chromium content is less than 1.0 mass %, a desired improvement in these characteristics cannot be achieved, and if the chromium content exceeds 30.0 mass %, a harmful TCP phase is likely to be formed. Therefore, the chromium content is 2.0 mass % or more but 25.0 mass % or less, preferably 5.0 mass % or more but 20.0 mass % or less, more preferably 12 mass % or more but 14.9 mass % or less.

Cobalt is a component useful for controlling a γ' phase solvus temperature. An increase in cobalt content reduces the γ' solvus temperature and widens a process window (ranges of various conditions in which a process such as forging can be industrially performed), and therefore a forgeability-improving effect can also be obtained. Particularly, when titanium is contained in a large amount, cobalt can be added in a slightly larger amount to suppress a TCP phase and improve high-temperature strength. The cobalt content is usually 19.5 mass % or more but 55.0 mass % or less. Based on the result of a high-temperature compression test, the compressive strength of a nickel-based heat-resistant superalloy whose cobalt content exceeds 55.0 mass % tends to reduce in a temperature region from room temperature to 750° C. Therefore, the upper limit of the cobalt content is generally 55.0 mass %. The cobalt content is more preferably 19.5 mass % or more but 35.0 mass % or less, even more preferably 21.8 mass % or more but 27.0 mass % or less.

Titanium is an addition element preferably used to strengthen a γ' phase to improve strength. A titanium content is usually 2.5 mass % or more but 15.0 mass % or less. When titanium is added in combination with cobalt, a more beneficial effect can be obtained by adding 5.1 mass % or more but 15.0 mass % or less of titanium. The addition of titanium in combination with cobalt makes it possible to achieve a nickel-based heat-resistant superalloy having excellent phase stability and high strength. Basically, a nickel-based heat-resistant superalloy that is stable in structure and has high strength even at a high alloy concentration can be achieved by selecting a heat-resistant superalloy having a γ/γ' two-phase structure and adding a Co—$Co_3Ti$ alloy having a γ/γ' two-phase structure just like the heat-resistant superalloy. In this case, the titanium content is within a range represented by the following formula.

That is, the titanium content is 0.17×(mass % of cobalt−23)+3 or more but 0.17×(mass % of cobalt−20)+7 or less.

However, if the titanium content exceeds 15.0 mass %, it is often the case that the formation of an η phase that is a harmful phase becomes conspicuous. Therefore, the upper limit of the titanium content is preferably 12.44 mass %. The titanium content is more preferably 5.5 mass % or more but 12.44 mass % or less, even more preferably 6.1 mass % or more but 11.0 mass % or less.

Aluminum is an element that forms a γ' phase, and an aluminum content is adjusted to form a γ' phase in a proper amount. The aluminum content is 0.2 mass % or more but 7.0 mass % or less. Further, the ratio between the titanium content and the aluminum content is strongly linked to the formation of an phase, and therefore in order to suppress the formation of a TCP phase that is a harmful phase, the aluminum content is preferably high to some extent. Further, aluminum is directly involved in the formation of an aluminum oxide on the surface of a nickel-based heat-resistant superalloy and is also involved in oxidation resistance. The aluminum content is preferably 1.0 mass % or more but 6.0 mass % or less, more preferably 2.0 mass % or more but 3.0 mass % or less.

Further, the nickel-based heat-resistant superalloy according to the present invention may contain the following elements as addition ingredients.

Molybdenum mainly has the effect of strengthening a γ phase and improving creep characteristics. Molybdenum is a high-density element, and therefore if its content is too high, the density of a nickel-based heat-resistant superalloy is increased, which is not preferred from a practical viewpoint. The molybdenum content is usually 10 mass % or less, preferably less than 4 mass %, more preferably 2.5 mass % or more but 3.0 mass % or less.

Tungsten is an element that is dissolved in a γ phase and a γ' phase and strengthens both the phases, and is therefore effective at improving high-temperature strength. If a tungsten content is low, there is a case where creep characteristics are poor. On the other hand, if the tungsten content is high, there is a case where the density of a nickel-based heat-resistant superalloy is increased because tungsten is a high-density element just like molybdenum. The tungsten content is usually 10 mass % or less, preferably less than 3 mass %, 0.8 mass % or more but 1.5 mass % or less.

Tantalum is effective as a strengthening element. On the other hand, if a tantalum content is high to some extent, a nickel-based heat-resistant superalloy has a high specific gravity and becomes expensive. The tantalum content is usually preferably 10 mass % or less.

Niobium is effective as a strengthening element and is also effective at controlling a specific gravity. On the other hand, if its content is high to some extent, there is a possibility that an undesirable phase is formed or cracks occur during hardening at high temperature. The niobium content is usually 5.0 mass % or less, preferably 0.1 mass % or more but 4.0 mass % or less.

The nickel-based heat-resistant superalloy according to the present invention may also contain, as another element, at least one element selected from vanadium, rhenium, magnesium, hafnium, and ruthenium as long as its characteristics are not impaired. For example, a vanadium content is 2 mass % or less, a rhenium content is 5 mass % or less, a magnesium content is 0.1 mass % or less, a hafnium content is 2 mass % or less, and a ruthenium content is 3 mass % or less. Ruthenium is effective at improving heat resistance and workability.

Further, the nickel-based heat-resistant superalloy according to the present invention may contain, as another element, at least one element selected from zirconium, carbon, and boron as long as its characteristics are not impaired. Zirconium is an element effective at improving ductility, fatigue characteristics, etc. Usually, a zirconium content is preferably 0.01 mass % or more but 0.2 mass % or less.

Carbon is an element effective at improving ductility and creep characteristics at high temperature. Usually, a carbon content is 0.01 mass % or more but 0.15 mass % or less, preferably 0.01 mass % or more but 0.10 mass % or less, more preferably 0.01 mass % or more but 0.05 mass % or less. Boron can improve creep characteristics, fatigue characteristics, etc. at high temperature. Usually, a boron content is 0.005 mass % or more but 0.1 mass % or less, preferably 0.005 mass % or more but 0.05 mass % or less, more preferably 0.01 mass % or more but 0.03 mass % or less. If the carbon content and boron content exceed their respective ranges described above, there is a case where creep strength is reduced or a process window becomes narrow.

The nickel-based heat-resistant superalloy according to the present invention is produced by melting a blended raw material having the above-described composition to prepare an ingot and forging this ingot. The nickel-based heat-resistant superalloy according to the present invention having a high cobalt content and a high titanium content has a wide process window and excellent forgeability and therefore can be produced efficiently. The prepared forged material is subjected to solution heat treatment and then to aging heat treatment so that the nickel-based heat-resistant superalloy according to the present invention is obtained. The nickel-based heat-resistant superalloy according to the present invention having a high cobalt content and a high titanium content and treated in the process of solution heat treatment in a high temperature region of 93% or more but less than 100%, preferably 94% or more but less than 100% of a γ' solvus temperature is excellent in both tensile strength and creep life even in a high temperature region in which excellent tensile strength and excellent creep life cannot conventionally be achieved.

A nickel-based heat-resistant superalloy is generally forged at a solvus temperature or higher at which the nickel-based heat-resistant superalloy has a single phase, because if a γ' phase that is a precipitation strengthening phase is present, ductility is reduced. On the other hand, the nickel-based heat resistant superalloy according to the present invention having a high cobalt content and a high titanium content exhibits excellent forgeability even in a temperature region less than a γ' solvus temperature. Therefore, the nickel-based heat-resistant superalloy according to the present invention forged in such a temperature region is excellent in both creep life and tensile strength and is very suitable for practical use.

Hereinbelow, the nickel-based heat-resistant superalloy according to the present invention will be described in more detail with reference to examples. As a matter of course, the present invention is not limited to the following examples.

EXAMPLES

Ingots of three kinds of inventive alloys (Inventive alloys 1 to 3) having compositions shown in Table 1 were prepared by triple melting in which three different melting processes, that is, vacuum induction melting, electroslag remelting, and vacuum arc remelting were performed, and were then subjected to homogenization heat treatment at about 1200° C. Then, the ingots were forged at 1100° C. on average to produce simulated turbine disks. Further, as comparative samples, simulated turbine disks were produced using typical existing alloys (Reference alloys 1 to 5) in the same manner as described above. The chemical compositions of the reference alloys are also shown in Table 1.

TABLE 1

| | Alloy composition (mass %) | | | | | | | γ' solvus temperature | |
|---|---|---|---|---|---|---|---|---|---|
| Alloy number | Ni | Cr | Mo | W | Co | Ti | Al | (° C.) | Notes |
| Inventive alloy 1 | Balance | 13.5 | 2.8 | 1.2 | 25.0 | 6.2 | 2.3 | ≈1162 | TMW alloy |
| Inventive alloy 2 | Balance | 13.8 | 2.6 | 1.1 | 25.0 | 5.6 | 2.2 | ≈1150 | TMW alloy |
| Inventive alloy 3 | Balance | 14.4 | 2.7 | 1.1 | 21.8 | 6.2 | 2.3 | ≈1166 | TMW alloy |
| Reference alloy 1 | Balance | 16.0 | 3.0 | 1.25 | 15.0 | 5.0 | 2.5 | ≈1158 | U720Li |
| Reference alloy 2 | Balance | 15.0 | 5.0 | — | 19.0 | 3.3 | 4.3 | — | Udimet700 |
| Reference alloy 3 | Balance | 18.0 | 4.0 | — | 18.0 | 3.0 | 2.9 | — | Udimet500 |

TABLE 1-continued

| Alloy number | Alloy composition (mass %) | | | | | | | γ' solvus temperature | Notes |
|---|---|---|---|---|---|---|---|---|---|
| | Ni | Cr | Mo | W | Co | Ti | Al | (° C.) | |
| Reference alloy 4 | Balance | 19.0 | 10.0 | — | 11.0 | 3.2 | 1.5 | — | Rene41 |
| Reference alloy 5 | Balance | 19.5 | 4.25 | — | 13.5 | 3.0 | 1.3 | — | Waspaloy |

The simulated turbine disks obtained by casting and forging Inventive alloys 1 to 3 and Reference alloy 1 (U720Li) were subjected to heat treatment in air for 4 hours at different solution heat treatment temperatures and then subjected to aging heat treatment. After the treatment, the samples were subjected to a creep life test. FIG. 1 shows a relationship between the ratio of solution heat treatment temperature (T) to γ' solvus temperature (Ts) (T/Ts) and creep life. As can be seen from FIG. 1, the creep life was excellent when the ratio of solution heat treatment temperature (T) to γ' solvus temperature (Ts) (T/Ts) was set to about 0.93 or more but less than 1.0. When the solution heat treatment temperature (T) was equal to or higher than the γ' solvus temperature (Ts), the creep life was rapidly reduced. Further, in the case of Reference alloy 1 (U720Li) showing the best performance among the existing nickel-based heat-resistant superalloys, a significant improvement in creep life was not observed even when the ratio of solution heat treatment temperature (T) to γ' solvus temperature (Ts) was brought close to 1.0, and its creep life was shorter than those of Inventive alloys 1 to 3. It has been found from these results that the nickel-based heat-resistant superalloys according to the present invention produced by a casting and forging method and having a high cobalt content and a high titanium content specifically exhibit excellent creep life when the ratio of solution heat treatment temperature (T) to γ' solvus temperature (Ts) (T/Ts) is set to about 0.93 or more but less than 1.0.

Figure 2:
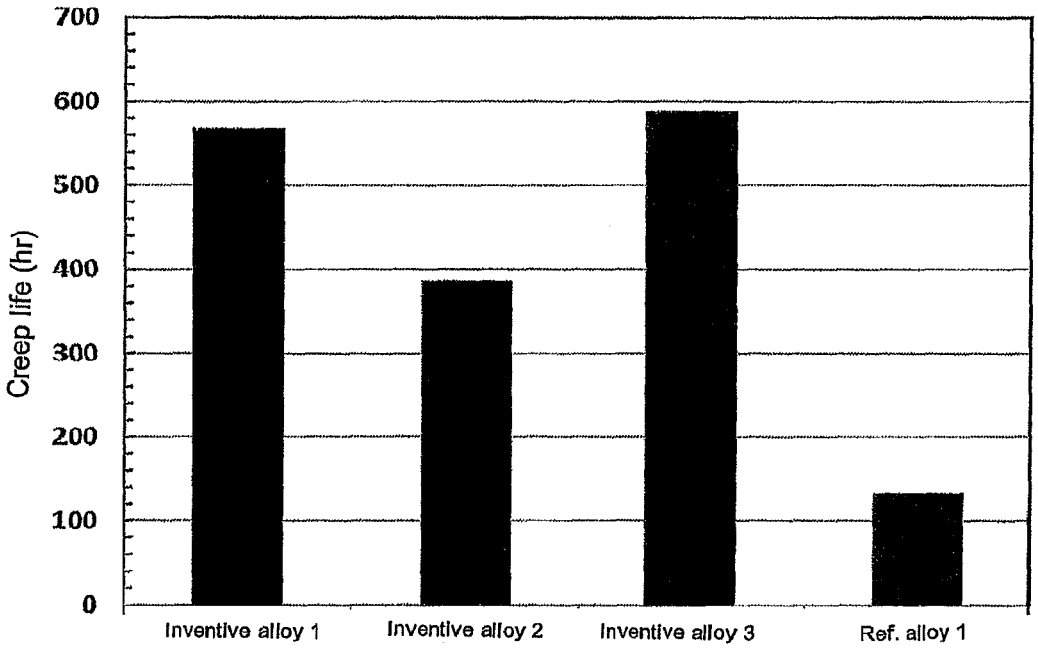
FIG. 2 shows a comparison of creep life among Inventive alloys 1 to 3 and Reference alloy 1 (test temperature: 725° C., applied stress: 630 MPa) when the ratio of solution heat treatment temperature (T) to γ' solvus temperature (Ts) was set to a constant value of 99%.

FIG. 2 shows a comparison of creep life among Inventive alloys 1 to 3 and Reference alloy 1 when the ratio of solution heat treatment temperature (T) to γ' solvus temperature (Ts) was a constant value of 99% (test temperature: 725° C., applied stress: 630 MPa). As can be seen from FIG. 2, the nickel-based heat-resistant superalloys according to the present invention having a high cobalt content and a high titanium content have a creep life about three to five times that of the commercially-available reference alloy (U720Li).

Figure 3:
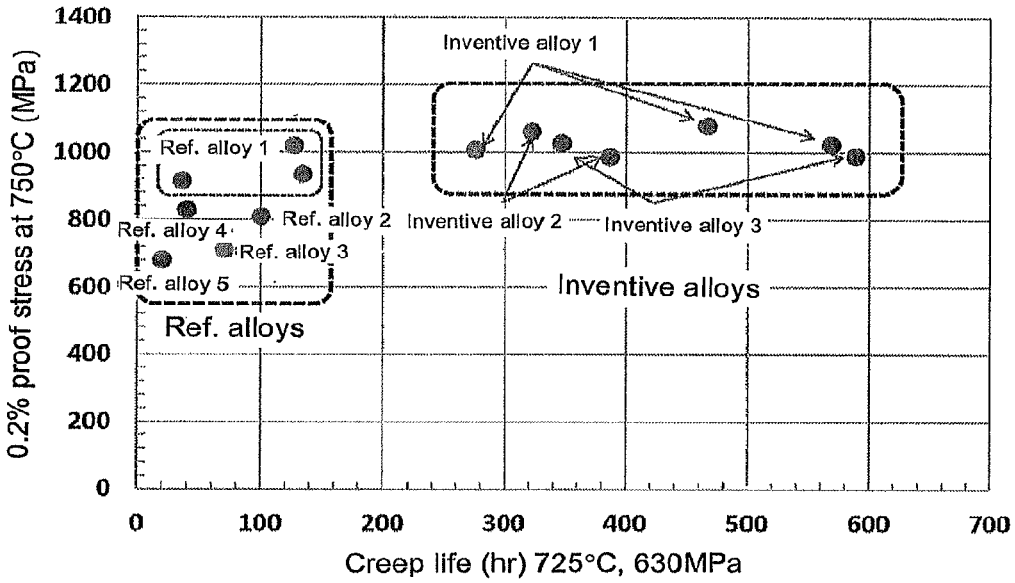
FIG. 3 shows a relationship between 0.2% proof stress (test temperature: 750° C.) and creep life (test temperature: 725° C., applied stress: 630 MPa) of Inventive alloys 1 to 3 and Reference alloys 1 to 5.

FIG. 3 shows a relationship between 0.2% proof stress (test temperature: 750° C.) and creep life (test temperature: 725° C., applied stress: 630 MPa) of Inventive alloys 1 to 3 and Reference alloys 1 to 5. As can be seen from FIG. 3, the nickel-based heat-resistant superalloys according to the present invention have not only significantly-improved creep life as compared to the existing nickel-based heat-resistant superalloys but also excellent tensile strength.

The above test results demonstrate that a nickel-based heat-resistant superalloy that satisfies the following three requirements is excellent in both creep life and tensile strength and is very suitable for practical use:

1) being a nickel-based heat-resistant superalloy produced by a casting and forging method;

2) comprising 2.0 mass % or more but 25 mass % or less of chromium, 0.2 mass % or more but 7.0 mass % or less of aluminum, 19.5 mass % or more but 55.0 mass % or less of cobalt, [0.17×(mass % of cobalt content−23)+3] mass % or more but [0.17×(mass % of cobalt content−20)+7] mass % or less and 5.1 mass % or more of titanium, and the balance being nickel and inevitable impurities; and 3) be subjected to solution heat treatment at 93% or more but less than 100% of a γ' solvus temperature.

INDUSTRIAL APPLICABILITY

It is possible to provide a nickel-based heat-resistant superalloy mainly having significantly-improved heat-resistant characteristics. The nickel-based heat resistant superalloy is useful for heat-resistant members of aircraft engines, power-generating gas turbines, etc., especially for high-temperature•high-pressure turbine disks, compressor blades, shafts, turbine cases, etc.

The invention claimed is:

1. A method for producing a nickel-based heat-resistant superalloy, consisting of the steps of:

preparing an ingot of a nickel-based heat-resistant superalloy by consecutive vacuum induction melting, electroslag remelting, and vacuum arc remelting;

homogenization-heat treating the ingot at about 1200° C.;

forging the homogenization-heat treated ingot at 1100° C. on average to make a product;

solution-heat treating the forged product at temperature range of 93% or more but less than 100% of a γ' solvus temperature; and aging the product after solution heat treatment, wherein the nickel-based heat-resistant superalloy has a composition consisting of 2.0 mass % or more but 25.0 mass % or less of chromium;

0.2 mass % or more but 7.0 mass % of less of aluminum;

19.5 mass % or more but 55.0 mass % or less of cobalt;

[0.17×(mass % of cobalt content−23)+3] mass % or more but [0.17×(mass % of cobalt content−20)+7] mass % or less and 5.1 mass % or more of titanium; and at least one optional element(s) selected from 10 mass % or less of molybdenum;

10 mass % or less of tungsten;

10 mass % or less of tantalum;

5.0 mass % or less of niobium;

2 mass % or less of vanadium;

5 mass % or less of rhenium;

0.1 mass % less of magnesium;

2 mass % or less of hafnium;

3 mass % or less of ruthenium;

0.01 mass % or more but 0.2 mass % or less of zirconium;

0.01 mass % or more but 0.15 mass % or less of carbon; and 0.005 mass % or more but 0.1 mass % or less of boron, and the balance being nickel and inevitable impurities.

2. The method according to claim 1, wherein the cobalt is contained in an amount of 21.8 mass % or more but 55.0 mass % or less in the composition.

3. The method according to claim 1, wherein the titanium is contained in an amount of 5.5 mass % or more but 12.44 mass % or less in the composition.

4. The method according to claim 3, wherein the titanium is contained in an amount of 6.1 mass % or more but 12.44 mass % or less in the composition.

5. The method according to claim 1, wherein the forged product is subjected to the solution heat treatment at a temperature range of 94% or more but less than 100% of the γ' solvus temperature.

6. The method according to claim 1, wherein the molybdenum is contained in an amount of less than 4 mass % in the composition.

7. The method according to claim 1, wherein the tungsten is contained in an amount of less than 3 mass % in the composition.

8. The method according to claim 1, wherein the composition consists of 12 mass % or more but 14.9 mass % or less of chromium;
2.0 mass % or more but 3.0 mass % or less of aluminum;
20.0 mass % or more but 27.0 mass % or less of cobalt;
5.5 mass % or more but 6.5 mass % or less of titanium;
0.8 mass % or more but 1.5 mass % or less of tungsten;
2.5 mass % or more but 3.0 mass % or less of molybdenum; and at least one optional element(s) selected from 0.01 mass % or more but 0.2 mass % or less of zirconium;
0.01 mass % or more but 0.15 mass % or less of carbon; and
0.005 mass % or more but 0.1 mass % or less of boron, and the balance being nickel and inevitable impurities.

* * * * *